US006141638A

United States Patent [19]

Peng et al.

[11] Patent Number: 6,141,638

[45] Date of Patent: Oct. 31, 2000

[54] METHOD AND APPARATUS FOR CODING AN INFORMATION SIGNAL

[75] Inventors: Weimin Peng, Mundelein; James Patrick Ashley, Naperville, both of Ill.

[73] Assignee: Motorola, Inc., Schaumburg, Ill.

[21] Appl. No.: 09/086,149

[22] Filed: May 28, 1998

[51] Int. Cl.[7] ..... G10L 9/00

[52] U.S. Cl. ..... 704/211; 704/221; 704/223

[58] Field of Search ..... 704/200, 201, 704/219, 220, 221, 222, 223, 211

[56] References Cited

U.S. PATENT DOCUMENTS

| | | | |
|---|---|---|---|
| 5,224,167 | 6/1993 | Taniguchi et al. | 704/219 |
| 5,642,368 | 6/1997 | Gerson et al. | 704/200 |
| 5,657,418 | 8/1997 | Gerson et al. | 704/207 |
| 5,657,419 | 8/1997 | Yoo et al. | 704/221 |
| 5,734,789 | 3/1998 | Swaminathan et al. | 704/208 |
| 5,819,213 | 10/1998 | Oshikiri et al. | 704/222 |
| 5,926,786 | 7/1999 | McDonough et al. | 704/224 |

OTHER PUBLICATIONS

Ramirez et al., "Efficient Algebraic Multipulse Search," SBT/IEEE International Telecommunications Symposium, vol. 1, pp. 231–236, Aug. 1998.

*Primary Examiner*—David R. Hudspeth
*Assistant Examiner*—Martin Lerner
*Attorney, Agent, or Firm*—Richard A. Sonnentag; Randi L. Dulaney

[57] ABSTRACT

A speech coder (400) for coding an information signal varies the codebook configuration based on parameters inherent in the information signal. The speech coder (400) requires no additional overhead for sending of mode parameters while allowing subframe resolution. The configurations vary not only for voicing level, but also for pitch period since different physiological traits yield different codebook configurations. A dispersion matrix (406) within the speech coder (400) facilitates a codebook search which is performed on vectors whose length can be less than a subframe length. Additionally, use of the dispersion matrix (406) allows the addition of random events for very slightly voiced speech which incurs little computational overhead but produces a rich excitation.

6 Claims, 4 Drawing Sheets

-PRIOR ART-

METHOD AND APPARATUS FOR CODING AN INFORMATION SIGNAL

RELATED APPLICATION

The present application is related to Ser. No. 09/086,396, titled "METHOD AND APPARATUS FOR CODING AND DECODING SPEECH" filed on the same date herewith, assigned to the assignee of the present invention and incorporated herein by reference.

FIELD OF THE INVENTION

The present invention relates, in general, to communication systems and, more particularly, to coding information signals in such communication systems.

BACKGROUND OF THE INVENTION

Code-division multiple access (CDMA) communication systems are well known. One exemplary CDMA communication system is the so-called IS-95 which is defined for use in North America by the Telecommunications Industry Association (TIA). For more information on IS-95, see TIA/EIA/IS-95, *Mobile Station-Base-station Compatibility Standard for Dual Mode Wideband Spread Spectrum Cellular System*, January 1997, published by the Electronic Industries Association (EIA), 2001 Eye Street, N.W., Washington, D.C. 20006. A variable rate speech codec, and specifically Code Excited Linear Prediction (CELP) codec, for use in communication systems compatible with IS-95 is defined in the document known as IS-127 and titled *Enhanced Variable Rate Codec, Speech Service Option 3 for Wideband Spread Spectrum Digital Systems*, September 1996. IS-127 is also published by the Electronic Industries Association (EIA), 2001 Eye Street, N.W., Washington, D.C. 20006.

In modern CELP decoders, there is a problem with maintaining high quality speech reproduction at low bit rates. The problem originates since there are too few bits available to appropriately model the "excitation" sequence or "codevector" which is used as the stimulus to the CELP synthesizer. Thus, a need exists for an improved method and apparatus which overcomes the deficiencies of the prior art.

DETAILED DESCRIPTION OF THE PREFERRED EMBODIMENT

Stated generally, a speech coder for coding an information signal varies the codebook configuration based on parameters inherent in the information signal. The speech coder requires no additional overhead for sending of mode parameters while allowing subframe resolution. The configurations vary not only for voicing level, but also for pitch period since different physiological traits yield different codebook configurations. A dispersion matrix within the speech coder facilitates a codebook search which is performed on vectors whose length can be less than a subframe length. Additionally, use of the dispersion matrix allows the addition of random events for very slightly voiced speech which incurs little computational overhead but produces a rich excitation.

Stated specifically, a method of coding an information signal includes the steps of selecting one of a plurality of configurations based on predetermined parameters related to the information signal, each of the plurality of configurations having a codebook and determining a codebook index from the codebook corresponding to the selected configuration. The method also includes the step of transmitting the predetermined parameters and the codebook index to a destination. In the preferred embodiment, the information signal comprises either a speech signal, video signal or an audio signal and the configurations are based on various classifications of the information signal. A corresponding apparatus implements the inventive method.

Figure 1:
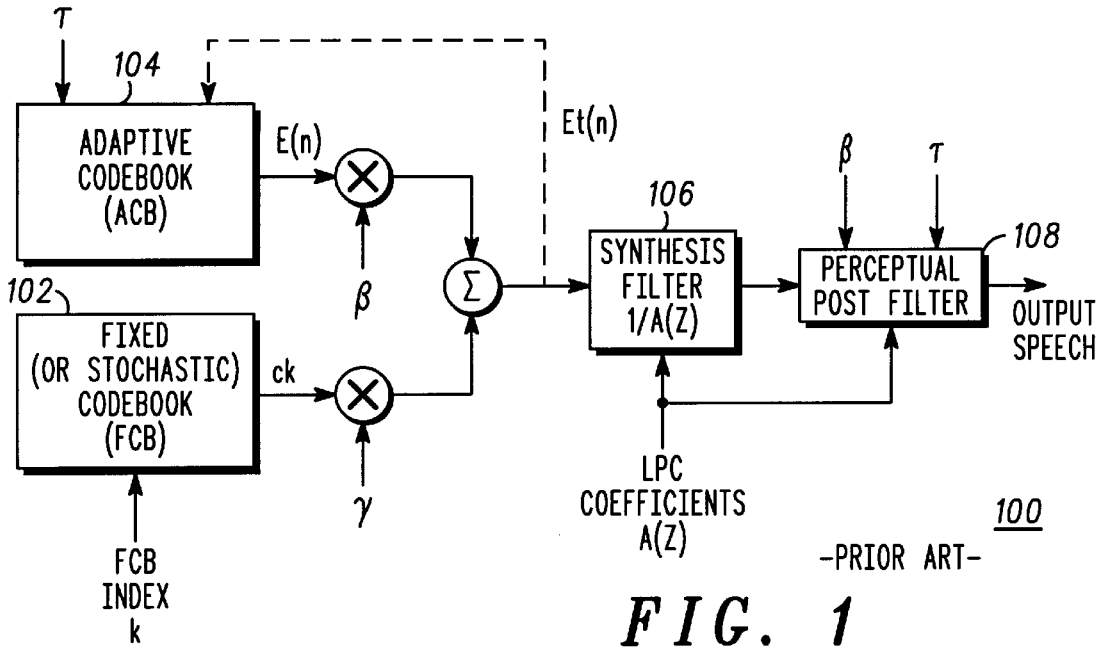
FIG. 1 generally depicts a CELP decoder as is known in the prior art.

FIG. 1 generally depicts a Code Excited Linear Prediction (CELP) decoder 100 as is known in the art. In modern CELP decoders, there is a problem with maintaining high quality speech reproduction at low bit rates. The problem originates since there are too few bits available to appropriately model the "excitation" sequence or "codevector" $c_k$ which is used as the stimulus to the CELP decoder 100.

As shown in FIG. 1, the excitation sequence or "codevector" $c_k$, is generated from a fixed codebook 102 (FCB) using the appropriate codebook index k. This signal is scaled using the FCB gain factor $\gamma$ and combined with a signal E(n) output from an adaptive codebook 104 (ACB) and scaled by a factor $\beta$, which is used to model the long term (or periodic) component of a speech signal (with period $\tau$). The signal $E_t(n)$, which represents the total excitation, is used as the input to the LPC synthesis filter 106, which models the coarse short term spectral shape, commonly referred to as "formants". The output of the synthesis filter 106 is then perceptually postfiltered by perceptual postfilter 108 in which the coding distortions are effectively "masked" by amplifying the signal spectra at frequencies that contain high speech energy, and attenuating those frequencies that contain less speech energy. Additionally, the total excitation signal $E_t(n)$ is used as the adaptive codebook for the next block of synthesized speech.

Figure 2:
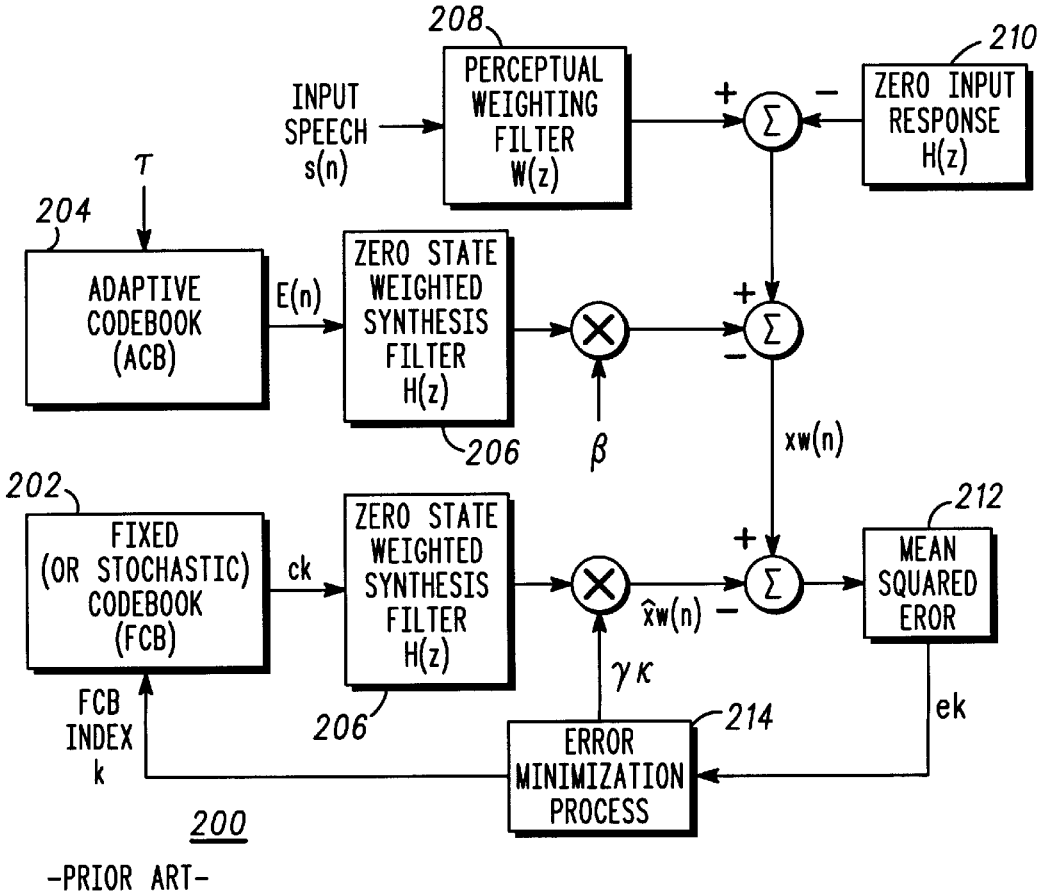
FIG. 2 generally depicts a Code Excited Linear Prediction (CELP) encoder as is known in the prior art.

FIG. 2 generally depicts a CELP encoder 200. Within CELP encoder 200, the goal is to code the perceptually weighted target signal $x_w(n)$, which can be represented in general terms by the z-transform:

$$X_w(z)=S(z)W(z)-\beta E(z)H_{ZS}(z)-H_{ZIR}(z), \tag{1}$$

where W(z) is the transfer function of the perceptual weighting filter 208, and is of the form:

$$W(z)=\frac{A(z/\lambda_1)}{A(z/\lambda_2)} \tag{2}$$

and H(z) is the transfer function of the perceptually weighted synthesis filters 206 and 210, and is of the form:

$$H(z) = \frac{1}{A_q(z)} W(z), \tag{3}$$

and where A(z) are the unquantized direct form LPC coefficients, $A_q(z)$ are the quantized direct form LPC coefficients, and $\lambda_1$ and $\lambda_2$ are perceptual weighting coefficients. Additionally, $H_{ZS}(z)$ is the "zero state" response of H(z) from filter 206, in which the initial state of H(z) is all zeroes, $H_{ZIR}(z)$ is the "zero input response" of H(z) from filter 210, in which the previous state of H(z) is allowed to evolve with no input excitation. The initial state used for generation of $H_{ZIR}(z)$ is derived from the total excitation $E_t(n)$ from the previous subframe.

To solve for the parameters necessary to generate $x_w(n)$, a fixed codebook (FCB) closed loop analysis in accordance with the invention is described. Here, the codebook index k is chosen to minimize the mean square error between the perceptually weighted target signal $x_w(n)$ and the perceptually weighted excitation signal $\hat{x}_w(n)$. This can be expressed in time domain form as:

$$\min_k \left\{ \sum_{n=0}^{L-1} (x_w(n) - \gamma_k c_k(n) * h(n)^2 \right\}, 0 \le k < M, \tag{4}$$

where $c_k(n)$ is the codevector corresponding to FCB codebook index k, $\gamma_k$ is the optimal FCB gain associated with codevector $c_k(n)$, h(n) is the impulse response of the perceptually weighted synthesis filter H(z), M is the codebook size, L is the subframe length, * denotes the convolution process and $\hat{x}_w(n)=\gamma_k c_k(n)*h(n)$. In the preferred embodiment, speech is coded every 20 milliseconds (ms) and each frame includes three subframes of length L.

Eq. 4 can also be expressed in vector-matrix form as:

$$\min_k\{(x_w-\gamma_k Hc_k)^T(x_w-\gamma_k Hc_k)\}, 0 \le k < M, \tag{5}$$

where $c_k$ and $x_w$ are length L column vectors, H is the L×L zero-state convolution matrix:

$$H = \begin{bmatrix} h(0) & 0 & 0 & \cdots & 0 \\ h(1) & h(0) & 0 & \cdots & 0 \\ h(2) & h(1) & h(0) & \cdots & 0 \\ \vdots & \vdots & \vdots & \ddots & \vdots \\ h(L-1) & h(L-2) & h(L-3) & \cdots & h(0) \end{bmatrix} \tag{6}$$

and $^T$ denotes the appropriate vector or matrix transpose. Eq. 5 can be expanded to:

$$\min_k\{x_w^T x_w - 2\gamma_k x_w^T Hc_k + \gamma_k^2 c_k^T H^T Hc_k\}, 0 \le k < M, \tag{7}$$

and the optimal codebook gain $\gamma_k$ for codevector $c_k$ can be derived by setting the derivative (with respect to $\gamma_k$) of the above expression to zero:

$$\frac{\partial}{\partial \gamma_k}(x_w^T x_w - 2\gamma_k x_w^T Hc_k + \gamma_k^2 c_k^T H^T Hc_k) = 0, \tag{8}$$

and then solve for $\gamma_k$ to yield:

$$\gamma_k = \frac{x_w^T Hc_k}{c_k^T H^T Hc_k}. \tag{9}$$

Substituting this quantity into Eq. 7 produces:

$$\min_k \left\{ x_w^T x_w - \frac{(x_w^T Hc_k)^2}{c_k^T H^T Hc_k} \right\}, 0 \le k < M. \tag{10}$$

Since the first term in Eq. 10 is constant with respect to k, it can be written as:

$$\max_k \left\{ \frac{(x_w^T Hc_k)^2}{c_k^T H^T Hc_k} \right\}, 0 \le k < M. \tag{11}$$

From Eq. 11, it is important to note that much of the computational burden associated with the search can be avoided by precomputing the terms in Eq. 11 which do not depend on k; namely, by letting $d^T=x_w^T H$ and $\Theta=H^T H$. When this is done, Eq. 11 reduces to:

$$\max_k \left\{ \frac{(d^T c_k)^2}{c_k^T \Theta c_k} \right\}, 0 \le k < M, \tag{12}$$

which is equivalent to equation 4.5.7.2-1 of IS-127. The process of precomputing these terms is known as "backward filtering".

In the IS-127 half rate case (4.0 kbps), the FCB uses a multipulse configuration in which the excitation vector $c_k$ contains only three non-zero values. Since there are very few non-zero elements within $c_k$, the computational complexity involved with Eq. 12 is relatively low. For the three "pulses," there are only 10 bits allocated for the pulse positions and associated signs for each of the three subframes (of length of L=53, 53, 54). In this configuration, an associated "track" defines the allowable positions for each of the three pulses within $c_k$ (3 bits per pulse plus I bit for composite sign of +, −, + or −, +, −). As shown in Table 4.5.7.4-1 of IS-127, pulse 1 can occupy positions 0, 7, 14, . . . , 49, pulse 2 can occupy positions 2, 9, 16, . . . , 51, and pulse 3 can occupy positions 4, 11, 18, . . . , 53. This is known as "interleaved pulse permutation," which is well known in the art. The positions of the three pulse are optimized jointly so Eq. 12 is executed $8^3$=512 times. The sign bit is then set according to the sign of the gain term $\gamma_k$.

Figure 3:
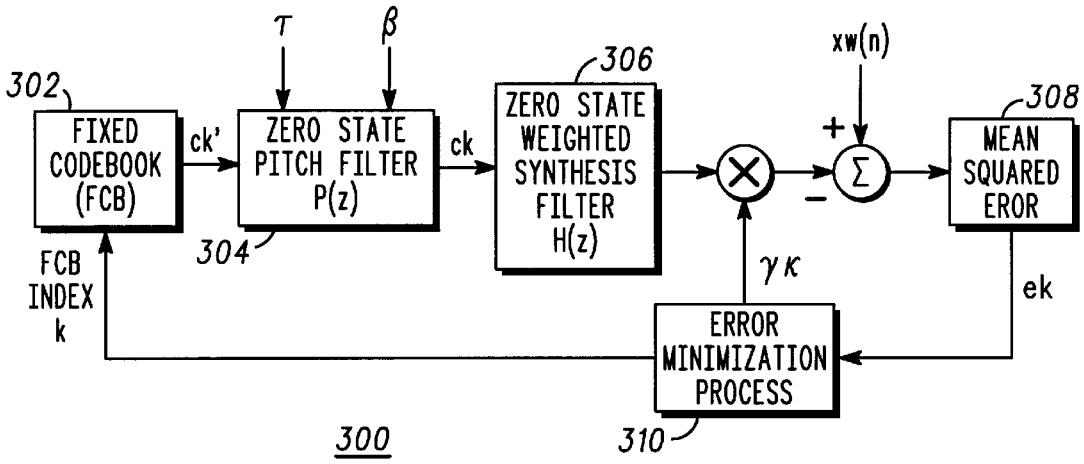
FIG. 3 generally depicts a CELP-based fixed codebook (FCB) closed loop encoder with pitch enhancement as is known in the prior art.

As stated above, the excitation codevector $c_k$ is not robust enough to model different facets of the input speech. The primary reason for this is that there are too few pulses which are constrained to too small a vector space. One method that is used to cope with voiced speech better is called "pitch sharpening" or "pitch enhancement." FIG. 3 generally depicts a CELP-based fixed codebook (FCB) closed loop encoder with pitch enhancement. This method, which is used in IS-127, correctly assumes that the adaptive codebook does not completely remove the pitch component, and then introduces a zero-state pitch filter P(z) at the output of the fixed codebook. The addition of the zero-state pitch filter P(z) at the output of the fixed codebook induces more periodic energy into the excitation signal $c_k$. For a complete understanding of the invention, the theory behind the pitch enhanced search procedure given in IS-127 is explained.

The transfer function of the pitch sharpening filter P(z) is given in IS-127 as:

$$P(z) = \frac{1}{1 - \beta z^{-\tau}}, \tag{13}$$

where β is the adaptive codebook gain and τ is the adaptive codebook pitch period. The minimum mean squared error (MMSE) criteria for the modified configuration can then be expressed in vector-matrix form as:

$$\min_k\{(x_w - \gamma_k HPc'_k)^T(x_w - \gamma_k HPc'_k)\},\ 0 \leqq k < M, \tag{14}$$

where $c'_k$ is the pitch filter input, and P is an L×L matrix given as:

$$P = \begin{bmatrix} 1 & 0 & \cdots & 0 & 0 & \cdots & 0 \\ 0 & 1 & \cdots & 0 & 0 & \cdots & 0 \\ \vdots & \vdots & \ddots & \vdots & \vdots & \ddots & \vdots \\ \beta & 0 & \cdots & 1 & 0 & \cdots & 0 \\ 0 & \beta & \cdots & 0 & 1 & \cdots & 0 \\ \vdots & \vdots & \ddots & \vdots & \vdots & \ddots & \vdots \\ 0 & 0 & \cdots & \beta & 0 & \cdots & 1 \end{bmatrix} \tag{15}$$

In this example of P, the pitch period τ is less than the subframe length L, but greater than L/2. If τ<L/2 (or L/3, etc.), higher order powers of β (i.e., $\beta^2$, $\beta^3$, etc.) would appear in lower left diagonals of P, and would be spaced τ rows/columns apart. Likewise, if τ≧L, P would default to the identity matrix I. For clarity, it is assumed that L/2≦τ<L.

Using the mean squared error minimization procedure above, the optimal codebook index k is found by maximization:

$$\max_k \left\{ \frac{(x_w^T HPc'_k)^2}{c'_k P^T H^T HPc'_k} \right\},\ 0 \le k < M. \tag{16}$$

Now, by letting H'=HP, H' can be calculated as:

$$H' = \begin{bmatrix} h(0) & 0 & \cdots & 0 & 0 & \cdots & 0 \\ h(1) & h(0) & \cdots & 0 & 0 & \cdots & 0 \\ \vdots & \vdots & \ddots & \vdots & \vdots & \ddots & \vdots \\ h(\tau) + \beta h(0) & h(\tau - 1) & \cdots & h(0) & 0 & \cdots & 0 \\ h(\tau + 1) + \beta h(1) & h(\tau) + \beta h(0) & \cdots & h(1) & h(0) & \cdots & 0 \\ \vdots & \vdots & \ddots & \vdots & \vdots & \ddots & \vdots \\ h(N - 1) + \beta h(N - \tau - 1) & h(N - 2) + \beta h(N - \tau - 2) & \cdots & h(\tau) + \beta h(0) & h(\tau - 1) & \cdots & h(0) \end{bmatrix} \tag{17}$$

As one may observe, the elements of matrix H' can be generated simply by filtering the impulse response h through the zero-state pitch enhancement filter P(z) as follows:

$$h'(n) = \begin{cases} h(n), & 0 \le n < \tau \\ h(n) + \beta h'(n - \tau), & \tau \le n < L \end{cases}. \tag{18}$$

This is equivalent to equation 4.5.7.1-4 in IS-127. By letting $d'^T = x_w^T H' = x_w^T HP$ and $\Theta = H'^T H' = P^T H^T HP$ and predetermining these quantities, the MMSE search criteria becomes independent of the filtered excitation $c_k$, and is dependent only on the original three pulse excitation $c'_k$:

$$\max_k \left\{ \frac{(d'^T c'_k)^2}{c'_k \Theta' c'_k} \right\},\ 0 \le k < M. \tag{19}$$

This point is crucial to understanding both the prior art and the invention.

After the optimal codebook index k is found, the pitch filtered excitation vector $c_k$ can be generated by:

$$c_k(n) = \begin{cases} c'_k(n), & 0 \le n < \tau \\ c'_k(n) + \beta c_k(n - \tau), & \tau \le n < L \end{cases}, \tag{20}$$

which is equivalent to equation 4.5.7.1-3 in IS-127.

While the pitch filtering improves performance for short pitch periods τ<L, it has no effect for longer periods L≦τ≦$\tau_{max}$, e.g., $\tau_{max}$=120. It also has relatively little impact when the closed loop pitch gain β is small, which may not directly correlate with overall target signal periodicity, especially during pitch transitions (i.e., a strong pitch component may be changing from subframe to subframe, resulting in a poor ACB prediction gain). It is also ineffective during very slightly voiced speech, in which noisy sounds can be "gritty" due to undermodeled excitation together with low amplitude due to poor correlation with the target signal.

Figure 4:
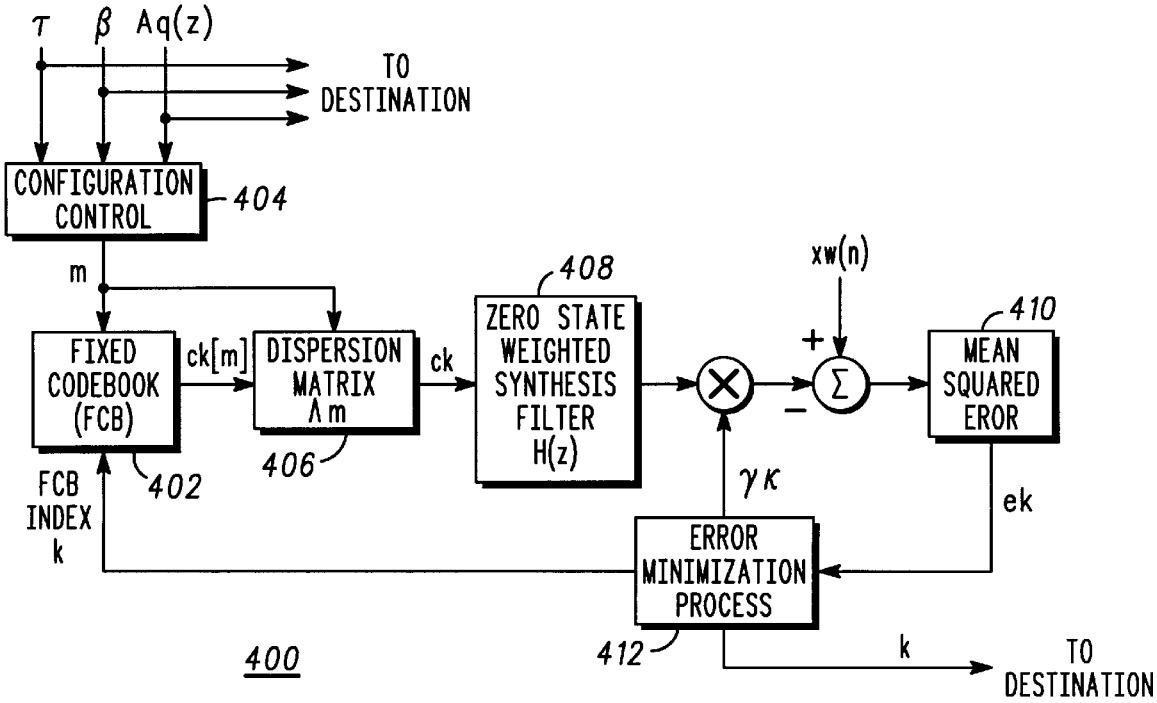
FIG. 4 generally depicts CELP-based FCB closed loop encoder with variable configuration in accordance with the invention.

FIG. 4 generally depicts a block diagram of a variable configuration FCB closed loop encoder 400 in accordance with the invention. As shown in FIG. 4, a configuration control block 404 and a dispersion matrix block 406 replace the pitch filtering block 304 in the prior art. Additionally, the fixed codebook block 402 can now vary with the configuration number m.

In accordance with the invention, when given a set of predetermined quantized speech parameters τ, β and $A_q(z)$, the excitation model is varied to take advantage of a particular mode of speech production that the predetermined parameters are most likely to represent. As an example, the prior art uses a multi-modal coding structure in which a four level voicing decision is made to determine a specific coding process. Three of the levels (strongly voiced, moderately voiced, and slightly voiced) simply use alternate fixed codebooks, while the fourth method (very slightly voiced) uses a combination of two fixed codebooks, and eliminates the adaptive codebook contribution. As is clear from FIG. 4, predetermined quantized speech parameters τ, β and $A_q(Z)$ and codebook index k are sent to a destination for use in a decoding process in accordance with the invention, such decoding process described below with reference to FIG. 6.

The variable configuration multipulse CELP speech coder and decoder and corresponding method in accordance with the invention differs from the prior art in, inter alia, the following ways:

1) the configuration mode decision is made on a subframe basis (typically 2 to 4 subframes per frame); in the prior art, the decision is made on a 20 ms frame basis;

2) the decision is made implicitly using quantized/transmitted parameters common to all configuration modes, thus there is no overhead. The prior art includes at least 1 bit in the transmitted bitstream for the voicing mode decision;

3) the fixed codebook configuration varies not only for voicing level, but also for pitch period. That is, a different configuration is used for long pitch periods than for middle and/or short pitch periods. While prior art does provide some provisions for pitch synchronicity, the speech production model is altered in accordance with the invention so as to mimic various phonation sources;

4) the codebook search space may be less than a subframe length. As with the prior art, the "backward filtering" process allows the codebook to be evaluated at the signal $c_k^{[m]}$. A unique element of the current invention is that the dispersion matrix $\Lambda_m$, can allow the dimension of $c_k^{[m]}$ to be less than L, according to some function of the pitch period $\tau$. The dimension of $c_k$ is then restored to L upon multiplication by $\Lambda_m$;

5) during very slightly voiced speech, the dispersion matrix is used to generate linear combinations of a single base vector. However, the search is evaluated at the signal $c_k^{[m]}$ using the same pulse configuration as the default voiced mode configuration, thus adding no complexity during the search;

6) the transferred predetermined quantized speech parameters $\tau$, $\beta$ and $A_q(z)$ and codebook index k are utilized for configuration control as described herein in accordance with the invention.

Using the same analysis techniques as in the prior art, the MMSE criteria in accordance with the invention can be expressed as:

$$\min_k\{(x_w-\gamma_k H\Lambda_m c_k^{[m]})^T(x_w-\gamma_k H\Lambda_m c_k^{[m]})\},\ 0\leqq k<M, \tag{21}$$

which is equivalent to Eq. 14 above except that the pitch sharpening matrix P is replaced by the variable dispersion matrix $\Lambda_m$. As in Eq. 16, the mean squared error is minimized by finding the value of k the maximizes the following expression:

$$\max_k\left\{\frac{(x_w^T H\Lambda_m c_k^{[m]})^2}{c_k^{[m]T}\Lambda_m^T H^T\Lambda_m c_k^{[m]}}\right\},\ 0\leq k<M. \tag{22}$$

As before, the terms $x_w$, H, and $\Lambda_m$ have no dependence on the codebook index k. We can thus let $d'^T=x_w^T H\Lambda_m$ and $\Theta'=\Lambda_m^T H^T H\Lambda_m=\Lambda_m^T\Theta\Lambda_m$ so that these elements can be computed prior to the search process. This simplifies the search expression to:

$$\max_k\left\{\frac{(d'^T c_k^{[m]})^2}{c_k^{[m]T}\Theta' c_k^{[m]}}\right\},\ 0\leq k<M, \tag{23}$$

which confines the search to the codebook output signal $c_k^{[m]}$. This greatly simplifies the search procedure since the codebook output signal $c_k^{[m]}$ contains very few non-zero elements. The dispersion matrix $\Lambda_m$, however, is capable of creating a wide variety of excitation signals $c_k$ in accordance with the invention, as will be described.

Figure 5:
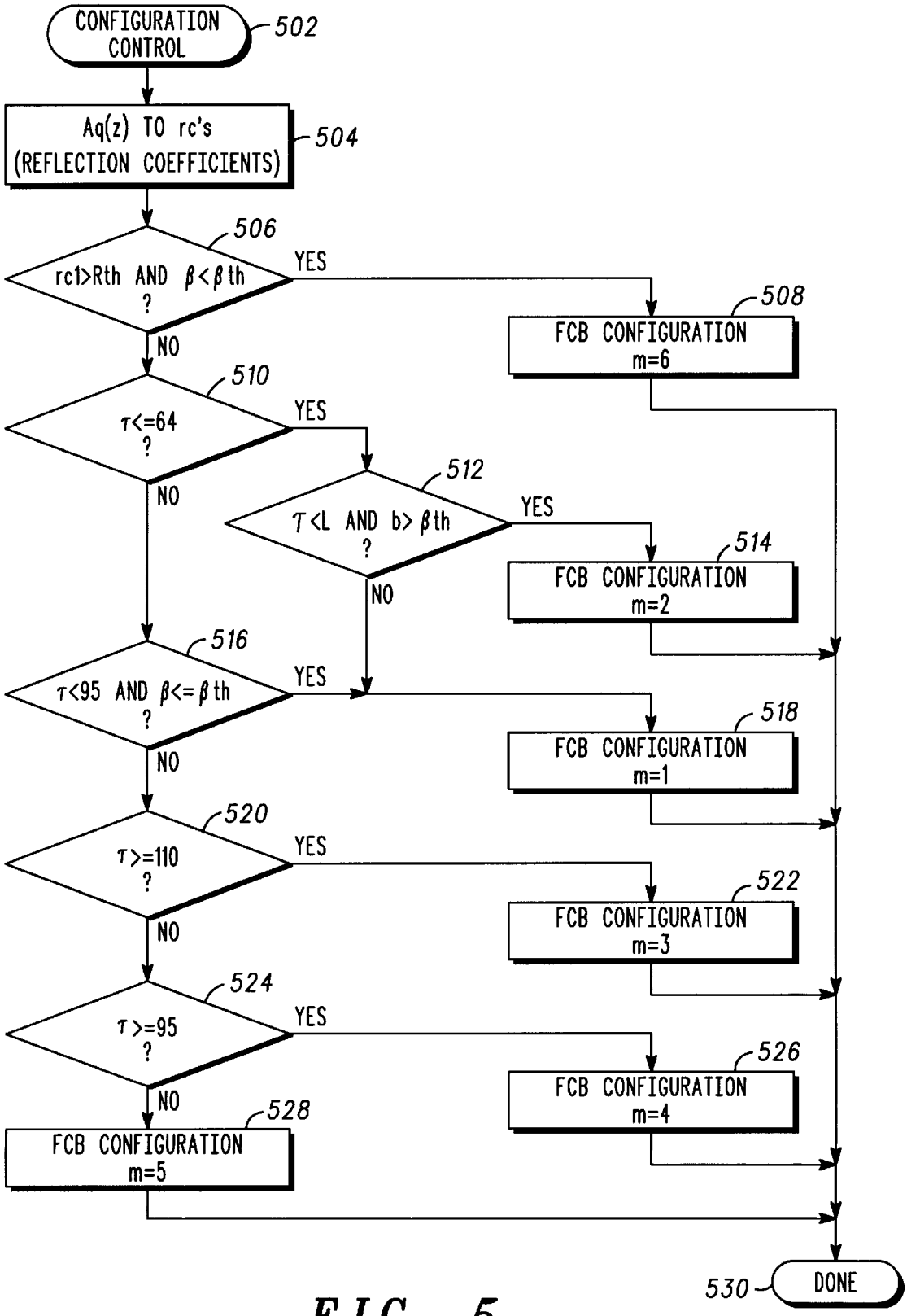
FIG. 5 generally depicts a flow chart depicting the process occurring within the configuration control block of FIG. 4 in accordance with the invention.
Figure 6:
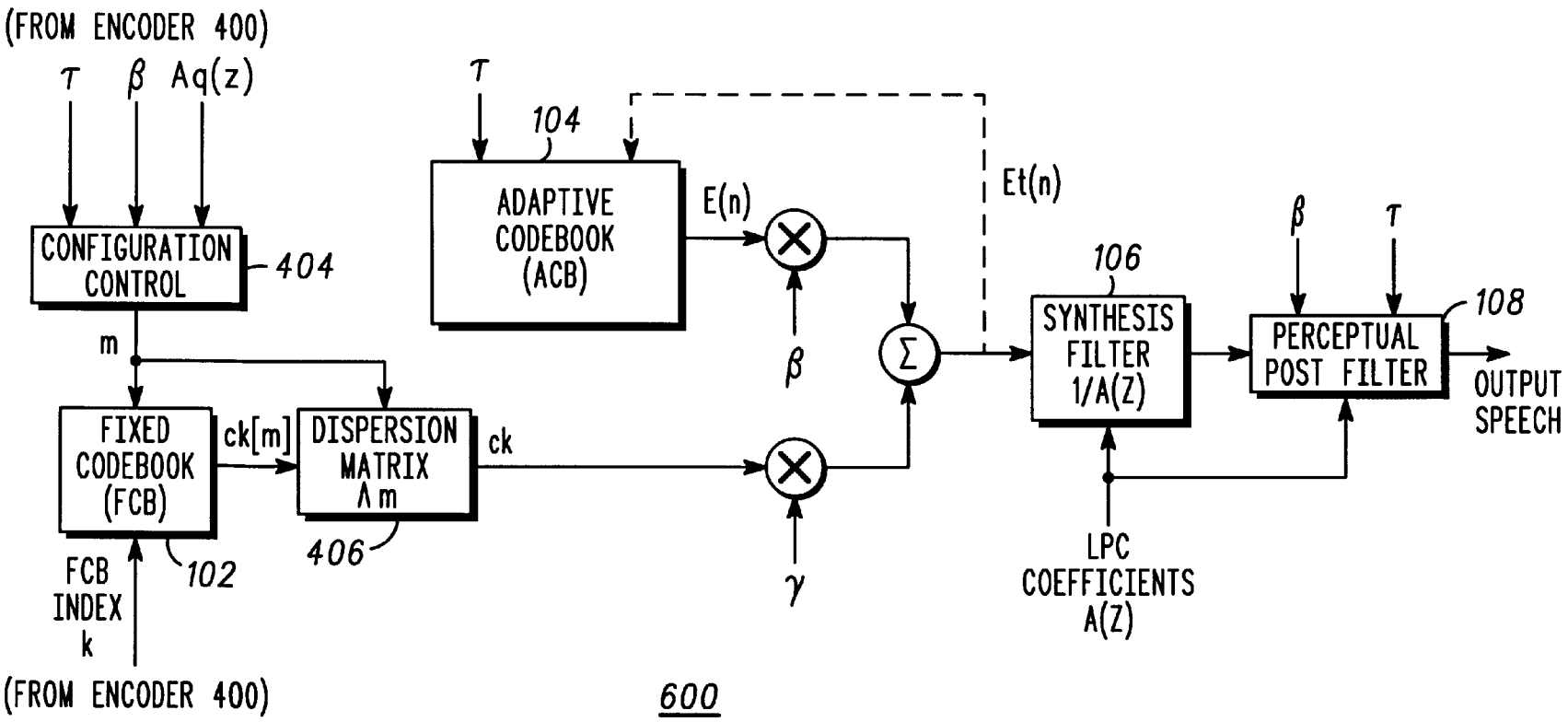
FIG. 6 generally depicts a CELP decoder implementing configuration control in accordance with the invention.

FIG. 5 generally depicts a flow chart depicting the process occurring within the configuration control block 404 of FIG. 4 and FIG. 6 in accordance with the invention. First, the quantized direct form LPC coefficients $A_q(z)$ are converted to a reflection coefficient vector $r_c$ at step 504; this process is well known. Next, a voicing decision is made at step 506: if the first reflection coefficient $r_c(1)$ is greater than some threshold $r_{th}$, and the quantized averaged ACB gain $\beta$ is less than some threshold $\beta_{th}$, the target signal $x_w$ is declared very slightly voiced, and FCB configuration m=6 is used as shown in step 508. Otherwise, the pitch period $\tau$, the quantized ACB gain $\beta$, and subframe length L are tested per the flow chart for various voicing attributes, which result in different codebook and/or dispersion matrices, each of which is discussed below.

Configuration 1 at step 518 is the default configuration. Here, the dispersion matrix $\Lambda_1$ is defined as the L×L identity matrix I, and the codebook structure is defined to be a three pulse configuration similar to the IS-127 half rate case. This configuration totals 10 bits per subframe which comprises 3 bits for 8 positions per pulse, and 1 global sign bit corresponding to [+, −, +] or [−, +, −] for each of the respective pulses. One exception to IS-127 is that the present invention utilizes a uniformly distributed interleaved pulse position codebook as opposed to the non-optimum IS-127 codebook which can actually place pulses outside the usable subframe dimension L. The present invention defines the allowable pulse positions for configuration 1 as:

$$p_i\epsilon\lfloor((Nn+i-1)L/NP)+0.5\rfloor,\ 0\leqq n<P,\ 1\leqq i\leqq N, \tag{24}$$

where N=3 is the number of pulses, L=53 (or 54) is the subframe length, P=8 is the number of positions allowed per pulse, and $\lfloor x\rfloor$ is the floor function which truncates x to the largest integer $\leqq x$. As an example, for a subframe length of 53, pulse $p_3\epsilon$[4,11,18,24,31,38,44,51], which is slightly different from that given in Table 4.5.7.4-1 of IS-127. While providing only minor performance improvement over the IS-127 configuration, the importance of this notation will become apparent for the following configuration.

Configuration 2 at step 514 is indicative of a strongly voiced input in which the pitch period $\tau$ is less than the subframe length L. In this configuration, the dimension of the codebook output signal $c_k^{[2]}$ is actually less than the subframe length L. Here, the length of $c_k^{[2]}$ is a function of the pitch period $f(\tau)$. In order to compensate for this in the MMSE Eq. 21, if $c_k^{[2]}$ is a column vector of dimension $f(t)$, then $\Lambda_2$ must be of dimension $L\times f(\tau)$. By defining the allowable pulse positions in $c_k^{[2]}$ as:

$$p_i\epsilon\lfloor((Nn+i-1)f(\tau)/NP)+0.5\rfloor,\ 0\leqq n<P,\ 1\leqq i\leqq N, \tag{24}$$

where $c_k^{[2]}$ is a $f(\tau)$ element column vector, N=3, and P=8. In the preferred embodiment, $f(\tau)$ is defined as $f(\tau)=\max\{\tau, \tau_{min}\}$, where $\tau_{min}$=NP=24. This prevents pulse position from overlapping when the pitch period is less than the total number of available pulse positions. By defining the $L\times f(\tau)$ dispersion matrix $\Lambda_2$ as:

$$\Lambda_2=\begin{bmatrix}1&0&\cdots&0\\0&1&\ddots&0\\\vdots&\ddots&\ddots&\vdots\\1&\ddots&\ddots&1\\0&1&\ddots&0\\0&0&\ddots&\vdots\\\vdots&\ddots&\ddots&\vdots\end{bmatrix}, \tag{25}$$

where $\Lambda_2$ consists of a leading ones diagonal, with a ones diagonal following every $\tau$ elements down to the Lth row, we can properly form the FCB contribution as $c_k=\Lambda_2 c_k^{[2]}$.

This configuration essentially duplicates pulses on intervals of $\tau$, similar to the pitch sharpening matrix P (Eq. 15) when $\beta=1$, except that only codebook vectors of length $f(\tau)$ are searched. This method provides superior resolution and accuracy over the prior art. The pulse signs are the same as that for configuration 1.

Configuration 3 at step 522 deals with strongly voiced speech in which the pitch period $\tau$ is very large ($\tau \geqq 110$ as shown in step 520), indicating large low frequency components. In this instance, it is deemed advantageous to adapt the codebook to more closely model the likely excitation corresponding to the target signal $x_w$. Since the pitch period is greater than twice the subframe length, the current subframe can contain not less than one half of a pitch period. In this case, two higher resolution pulses of the same sign can more accurately represent the low frequency energy than three lower resolution pulses of alternating sign. The two pulse positions can be described in general terms as:

$$p_i \in \left\lfloor \left( \frac{(Nn+i-1)L}{\sum_{j=1}^{N} P_j} \right) + 0.5 \right\rfloor, 0 \le n < P_i, 1 \le i \le N, \tag{26}$$

where N=2, $P_1=23$, and $P_2=22$. This corresponds to $p_1 \epsilon$[0, 2,5,7,9,12, . . . , 49,52] and $p_2 \epsilon$[1,4,6,8,11,13, . . . , 48,51]. The sign/positions of the two pulses can be coded efficiently using 10 bits using the relation $k=512*s+22*k_1+k_2$, where k is the 10 bit codeword, $k_1$ and $k_2$ are the respective optimal indices into the $p_1$ and $p_2$ arrays, and s represents the sign of both $p_1$ and $p_2$.

Furthermore, the dispersion matrix is structured to more appropriately model the shape of the low frequency glottal excitation. By defining $\Lambda_3$ as the L×L matrix $$\Lambda_3 = g \begin{bmatrix} 1 & 0 & 0 & 0 & 0 & \cdots & 0 & 0 \\ d & 1 & 0 & 0 & 0 & \cdots & 0 & 0 \\ d^2 & d & 1 & 0 & 0 & \cdots & 0 & 0 \\ d^4 & d^2 & d & 1 & 0 & \cdots & 0 & 0 \\ 0 & d^4 & d^2 & d & 1 & \cdots & 0 & 0 \\ \vdots & \vdots & \vdots & \vdots & \vdots & \ddots & \vdots & \vdots \\ 0 & 0 & 0 & 0 & 0 & \cdots & 1 & 0 \\ 0 & 0 & 0 & 0 & 0 & \cdots & d & 1 \end{bmatrix}, \tag{27}$$

we thereby "spread" the pulse energy over several samples of decaying magnitude. Here, $g=1/(\lambda^T\lambda)^{1/2}$ is the gain normalization term, where $\lambda$ is defined as the first column vector of $\Lambda_3$, and d is a decay factor which is related to the pitch period by:

$$d = 0.5 + 0.25\left(\frac{\tau - 110}{\tau_{\max} - 110}\right), \tag{28}$$

where $\tau_{max}=120$. Additionally, if the spaces of the two pulses in the codebook overlap, a more comprehensive shape can be formed at the composite codebook excitation $c_k$. This matrix, as with other dispersion matrices, can be efficiently combined with the H matrix prior to the codebook search so that the search complexity is not impacted by this selection of $\Lambda_3$.

Configuration 4 at step 526 is similar in concept to configuration 3 for strongly voiced pitch periods between 95 and 109. Here, the same pulse position and sign convention is used, the difference being that the glottal excitation model described by $\Lambda_3$ is no longer valid. For configuration 4, the matrix $\Lambda_4$ is defined simply as an L×L identity matrix I.

Configuration 5 at step 528, which models strongly voiced speech with pitch periods between 65 and 94, is also similar to configuration 3. In addition to $\Lambda_5$ being defined as an L×L identity matrix I, the signs of the pulses are defined to be alternating. This is because the pitch period is now approaching the subframe length, and a complete pitch period should contain no DC component.

Configuration 6 at step 508 is used for modeling very slightly voiced speech, and is appropriately diverse in application. The fundamental problem with very slightly voiced speech, or noise-like sounds, is that a few pulses does not provide the richness needed for good overall sound quality. In addition, the normalized cross correlation (what we are trying to maximize in Eq. 22) between the multipulse codebook signal and a noisy target signal will ultimately be very low, which results in low FCB gain, and hence, synthesized speech with energy significantly lower than that of the original speech. Configuration 6 solves this problem as follows:

By using the default three pulse configuration as in configuration 1, and defining $\Lambda_6$ as the L×L matrix:

$$\Lambda_6 = \begin{bmatrix} v(0) & v(L-1) & \cdots & v(1) \\ v(1) & v(0) & \cdots & v(2) \\ \vdots & \vdots & \ddots & \vdots \\ v(L-1) & v(L-2) & \cdots & v(0) \end{bmatrix}. \tag{29}$$

where v=[v(0),v(1), . . . , v(L−1)] is a length L vector containing preferably $N_p=4$ non-zero values of magnitude $1/\sqrt{N_p}$ and alternating signs. The positions within v having non-zero values are generated by a mutually exclusive uniform random number generator over the interval [0, L−1]. This sequence is generated independently by the encoder and decoder, which can be synchronized by seeding the random number generator with a common value, such as the incremental subframe number or with a transmitted parameter, such as the LPC index. By defining $\Lambda_6$ this way, each pulse within the codevector $c_k^{[6]}$ is capable of generating an independent circular phase of the base vector v. Moreover, when the multiple pulses are considered, a linear combination of the various phases of v is generated. This results in up to $NN_p=12$ pulses total in the composite FCB response $c_k$, while searching the usual three pulses, as in configuration 1. Again, there is some minimal overhead in pre-computing the denominator in Eq. 23, but the search is performed independently of $\Lambda_6$. It is also worth noting that well known autocorrelation methods can be incorporated further simplifying configuration 6, without any measurable degradation in performance.

FIG. 6 generally depicts a CELP decoder 600 implementing configuration control in accordance with the invention. Several blocks shown in FIG. 6 are common with blocks shown in FIG. 1, thus those common blocks are not described here. As shown in FIG. 6, configuration control block 404 and dispersion matrix 406 are included in decoder 600. When predetermined quantized speech parameters $\tau$, $\beta$ and $A_q(Z)$ (sent by encoder 400) are received by decoder 600, configuration control block 404 uses these parameters to determine the configuration m for the particular sample of coded speech. Fixed codebook 102 uses codebook index k (sent by encoder 400) as input to generate output $c_k^{[m]}$ which is input into dispersion matrix 406. Dispersion matrix 406 outputs excitation sequence $c_k$ which is then combined with the scaled output of adaptive codebook 104 and passed through synthesis filter 106 and perceptual post filter 108 to eventually generate the output speech signal in accordance with the invention.

While the invention has been particularly shown and described with reference to a particular embodiment, it will be understood by those skilled in the art that various changes in form and details may be made therein without departing from the spirit and scope of the invention. The corresponding structures, materials, acts and equivalents of all means or step plus function elements in the claims below are intended to include any structure, material, or acts for performing the functions in combination with other claimed elements as specifically claimed.

What we claim is:

1. A method of coding an information signal comprising the steps of:

selecting one of a plurality of configurations based on predetermined parameters related to the information signal, each of the plurality of configurations having a codebook;

searching the codebook over a length of a codevector which is shorter than a subframe length to determine a codebook index from the codebook corresponding to the selected configuration; and transmitting the predetermined parameters and the codebook index to a destination.

2. The method of claim 1, wherein the information signal further comprises either a speech signal, video signal or an audio signal.

3. The method of claim 1, wherein the configurations are based on various classifications of the information signal.

4. An apparatus for coding an information signal comprising:

means for selecting one of a plurality of configurations based on predetermined parameters related to the information signal, each of the plurality of configurations having a codebook;

means for searching the codebook over a length of codevector which is shorter than a subframe length to determine a codebook index from the codebook corresponding to the selected configuration; and means for transmitting the predetermined parameters and the codebook index to a destination.

5. The apparatus of claim 4, wherein the information signal further comprises either a speech signal, video signal or an audio signal.

6. The apparatus of claim 4, wherein the configurations are based on various classifications of the information signal.

* * * * *